US005257808A

United States Patent [19]

Mueller et al.

[11] Patent Number: 5,257,808

[45] Date of Patent: Nov. 2, 1993

[54] GAME BALL TARGET

[76] Inventors: Jay Mueller, 9900 Crestwick Dr., St. Louis, Mo. 63128; Gary A. Crabtree, 1154 Briarhurst, St. Louis; Roger K. Crabtree, 285 Village Mead, Ballwin, both of Mo. 63021

[21] Appl. No.: 906,399

[22] Filed: Jul. 1, 1992

[51] Int. Cl.[5] ..... A63B 69/36

[52] U.S. Cl. ..... 273/178 R; 273/181 A

[58] Field of Search ..... 273/178 R, 178 A, 177 R, 273/177 A, 181 A

[56] References Cited

U.S. PATENT DOCUMENTS

| | | | |
|---|---|---|---|
| 158,991 | 1/1875 | Smith | 273/425 X |
| 1,287,903 | 12/1918 | Daily | 273/178 R |
| 1,513,968 | 11/1924 | Crandall | 273/425 X |
| 2,080,489 | 5/1937 | Knorpp | 273/100 |
| 2,146,457 | 2/1939 | Vernon | 273/106 |
| 2,283,462 | 5/1942 | Richie | 273/178 A |
| 2,506,932 | 5/1950 | McAfee | 273/106 |
| 3,490,769 | 1/1970 | Torbett | 273/181 |
| 4,012,042 | 3/1977 | Blasingame | 273/95 |
| 4,171,134 | 10/1979 | Reck | 273/181 R |
| 4,204,682 | 5/1980 | Brown | 273/401 |
| 4,256,308 | 3/1981 | Schlueter et al. | 273/177 A |
| 4,275,886 | 6/1981 | Bannon | 273/178 R |
| 4,392,653 | 7/1983 | Blume, Sr. | 273/400 |
| 4,531,745 | 7/1985 | Leidy | 273/336 |
| 4,539,225 | 11/1982 | Baldorossi et al. | 273/178 A |
| 4,565,375 | 1/1986 | Dresel | 273/401 |
| 4,717,156 | 1/1988 | Wright | 273/401 |
| 4,878,671 | 11/1989 | Grubany | 273/176 R |
| 4,906,006 | 3/1990 | Sigunick | 273/178 R |

*Primary Examiner*—George J. Marlo
*Attorney, Agent, or Firm*—Heller & Kepler

[57] ABSTRACT

A golf practice device has a flexible weighted ring and a sloped shoulder. A bottom surface includes an array of gripping projections generally encircling the ball receiving opening defined by the ring. The game target is placed upon a natural ground surface and uses the natural ground surface as a target to better simulate actual playing conditions.

7 Claims, 3 Drawing Sheets

GAME BALL TARGET

BACKGROUND OF THE INVENTION

The present invention relates in general to games and targets for playing games and pertains, more particularly, to a practice device for golf directed to improving chipping and related strokes. The target of this invention is an improvement over conventional targets for use in practicing golf strokes or for providing targets for other sports.

A number of the conventional target devices used for practicing golf only provide for practicing a putting stroke. Other target devices that are used to practice a chipping stroke include artificial surfaces that do not replicate actual playing conditions.

Another drawback associated with these target devices is that the practice results leave the user unsure as to how the ball would play under actual golf course conditions. Existing targets also have a drawback associated with the construction utilizing smooth surfaces that result in the target moving around on the surface on which it is placed.

Other devices use a combination of rings and flags that generally affix the flags but not the rings. The result would appear to be another target that can move around if the ball strikes one of the rings. More rigid target constructions result in a target that requires substantial time for assembly and disassembly.

SUMMARY OF THE INVENTION

Accordingly, it is an object of the present invention to provide an improved game target that is adapted to allow for practice with a goal of improved performance during actual playing. With the target of this invention it is believed that the balls will fall on an actual playing surface or the equivalent and the user of the target will benefit from the reproduction of actual playing conditions.

Another object of the present invention is to provide an improved game target that is constructed to provide ease of use and to thus provide regular use.

A further object of the present invention is to provide an improved game target that is adapted for use in any number of conditions that simulate actual playing conditions for the game being practiced.

To accomplish these and other objects of this invention there is provided a game target that is placed upon a natural ground surface. The game target comprises a ring member defining a target area. A bottom surface and a top surface cooperate to form a sloped or tapered surface. Gripping projections are located on or formed in the bottom surface of the target.

The game target of the present invention is preferably adapted for practicing golf and can be located on the terrain desired to simulate actual playing surfaces or a slope to simulate terraced playing areas or greens. The game target of the present invention can be located on high grass or short grass or hard packed grass to simulate playing conditions experienced at different golf courses or different weather related playing conditions.

In the disclosed embodiment gripping means include a plurality of projections formed in the bottom surface of the target. Also, in the preferred embodiment the ring is a flexible material and the ring can have a variety of colors for use in playing other games with the targets.

These and other objects and features of the present invention will be better understood and appreciated from the following detailed description of one embodiment thereof, selected for purposes of illustration and shown in the accompanying drawing.

DETAILED DESCRIPTION

Figure 1:
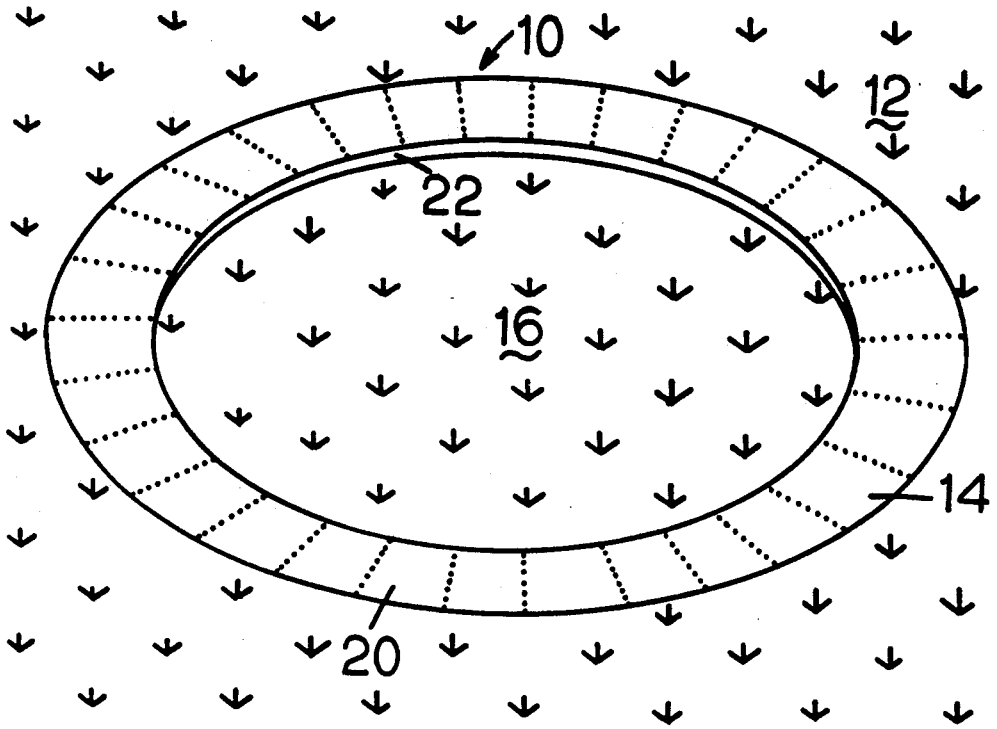
FIG. 1 is a perspective view of a game target constructed in accordance with the present invention located on a surface representing a generic playing surface.

Referring now to the drawings there is shown a preferred embodiment for the game target of this invention. The game target is described in connection with a golf practice application to practice the chip shot and other similar strokes. The game target of the present invention is particularly adapted for providing realistic practice conditions and is characterized by an ability to be located on flat or contoured or sloping ground of the choice of the user.

The drawings show the game target or sports target 10 in conjunction with a playing area 12 that comprises a ring member 14 that defines a target area 16.

The ring member 14 has a bottom surface 18 and a sloped top surface 20. An inner facing upright surface 22 provides the edge of the target area 16.

In operation, in connection with the game target previously mentioned to practice golf strokes, the game target is placed upon a desired playing surface. The user can locate the target 10 on a grassy spot or a hard smooth spot or other location. Each location would then provide a target area 16 on a playing area 12 that is the same surface as that found during actual play.

In a preferred embodiment the target 10 would be manufactured from a flexible plastic and brightly colored. As illustrated in the drawings, a plurality of gripping projections 24 would be molded into the bottom surface 18.

From the foregoing description those skilled in the art will appreciated that all of the objects of the present invention are realized. A game target has been shown and described for providing the desired game target adapted to allow for practice with a goal of improved performance during actual playing. Balls will fall on an actual playing surface or the equivalent and the user of the target will benefit from the reproduction of actual playing conditions.

The present invention provides a game target constructed to provide ease of use and to thus provide regular use. The improved game target can be used in any number of conditions that simulate actual playing conditions for the game being practiced.

While a specific embodiment has been shown and described, many variations are possible. The particular size of the ring or target area can be changed as desired. Clearly a smaller target area provides a greater challenge. It will be understood that the target 10 can be put to other recreational uses, for example, by using other balls or flying discs with the target with the players creating their own games of skill.

Figure 2:
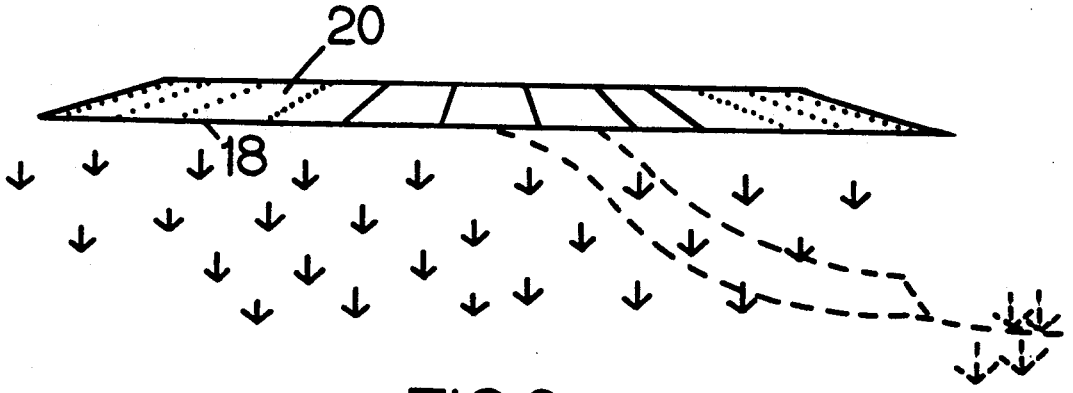
FIG. 2 is a side elevational view of the game target depicted in FIG. 1.
Figure 3:
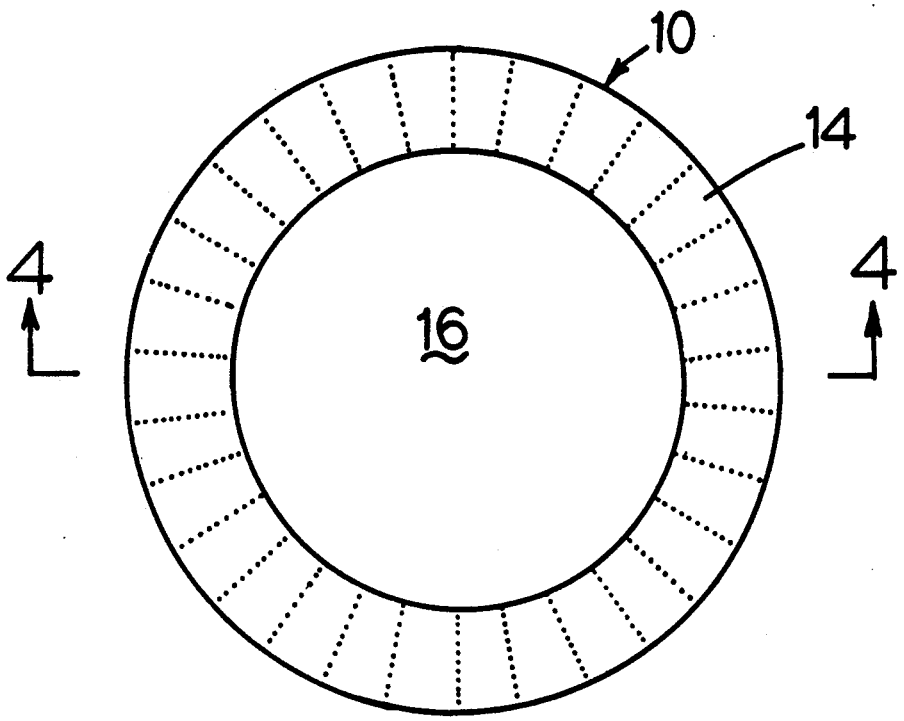
FIG. 3 is a top plan view of the game target depicted in FIG. 1.

The ring materials may vary although a flexible rubber like material suitable for extended outside use is preferred. However, the device may be manufactured from different, suitable materials. The shape of the gripping projections 24 may be changed. Instead of being formed on the bottom surface, the projections could be added by attaching a sheet with projections to the bottom surface of the target 10. The target 10 is depicted on a slope in FIG. 2.

Figure 4:
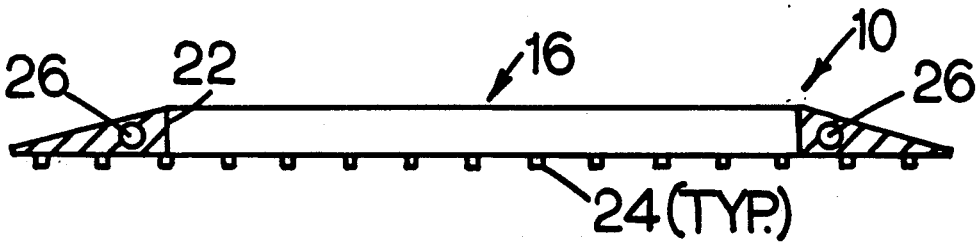
FIG. 4 is a cross-sectional view taken along line 3—3 in FIG. 3.
Figure 5:
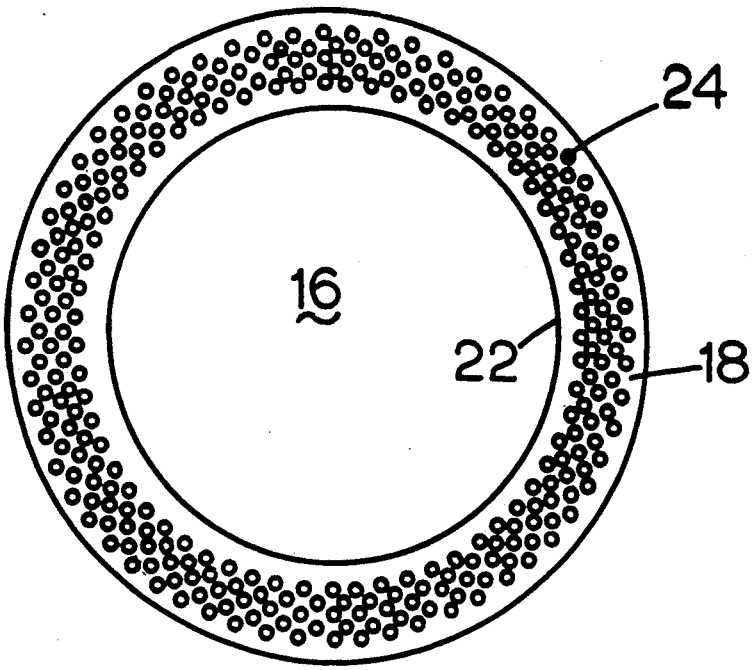
FIG. 5 is a bottom plan view of the game target depicted in FIG. 1.

In another embodiment of the invention a flexible weight 26 could be formed in the ring as illustrated in FIG. 4

Having described the invention in detail, those skilled in the art will appreciated that modifications may be made of the invention without departing from its spirit. Therefore, it is intended that the scope of this invention be determined by the appended claims and their equivalents.

What is claimed is:

1. A game target for practice and play, comprising:

means for defining a target including an upper surface forming an area over which a putted golf ball may roll and a lower surface underlying said upper surface and generally coextensive therewith, the target means including a generally flexible ring-shaped member;

the target defining means providing an opening encircled by said surfaces, thereby exposing the natural surface underneath the target; and friction means for maintaining the target in place on the natural surface, the maintaining means including an array of projections extending from said lower surface of the target means and generally encircling said opening.

2. A game target as set forth in claim 1 wherein the friction means is a plurality of projections molded in the lower surface of the target.

3. A game target as set forth in claim 1 further comprising means for weighting the target.

4. A game target as set forth in claim 1 further including a weight.

5. A game target as set forth in claim 1 wherein the weight is located inside the target.

6. A game target as set forth in claim 1 wherein the upper surface and the lower meet to form an acute angle which defines a slope of the upper surface.

7. A game target as set forth in claim 1 wherein the projections are molded in the material of the lower surface of the target.

* * * * *